United States Patent [19]

Boatwright

[11] 4,212,628

[45] Jul. 15, 1980

[54] RECOVERY FURNACE SAFETY SYSTEM

[75] Inventor: William H. Boatwright, Covington, Va.

[73] Assignee: Westvaco Corporation, New York, N.Y.

[21] Appl. No.: 33,330

[22] Filed: Apr. 25, 1979

[51] Int. Cl.[2] ..... F27D 7/02; F27D 9/00

[52] U.S. Cl. ..... 432/4; 431/153; 431/186; 432/90

[58] Field of Search ..... 432/4, 90; 431/153, 431/186, 189

[56] References Cited

U.S. PATENT DOCUMENTS

| | | | |
|---|---|---|---|
| 3,191,658 | 6/1965 | Schuss et al. | 431/186 X |
| 3,817,693 | 6/1974 | Sebens et al. | 431/153 |
| 4,008,042 | 2/1977 | Auvil et al. | 432/4 |

*Primary Examiner*—John J. Camby
*Attorney, Agent, or Firm*—W. Allen Marcontell; Richard L. Schmalz

[57] ABSTRACT

During a clean-out period when black liquor supply lines to paper pulp mill recovery furnace fuel spray guns are circulated with purge water or when black liquor firing is interrupted due to low consistency solids, the removal and unauthorized insertion of such fuel spray guns is positively verified and prevented by swing gates and series condition switches respective to each gun port. In order for a liquor circulation pump to be restarted following an automatic shutdown, all gates must be closed across respective gun ports which simultaneously closes all gate switches.

12 Claims, 2 Drawing Figures

RECOVERY FURNACE SAFETY SYSTEM

BACKGROUND OF THE INVENTION

1. Field of the Invention

The present invention relates to recovery boiler furnace safety appliances. More specifically, the invention is directed to safe operating methods and apparatus for paper pulp mill recovery furnaces adapted to burn concentrated black liquor.

2. Description of the Prior Art

Pursuant to present-day paper pulp mill operations, raw wood is delignified by a thermo-chemical process comprising an approximately 350° F. cook in the presence of sodium hydroxide, sodium carbonate, sodium sulfide and other sodium based compounds. Under such conditions, the lignin binder in the raw wood matrix which holds the natural cellulose fibers together reacts with the sodium compounds to form water soluble lignin-sodium complexes thereby permitting a water wash separation of the black, tar-like lignin from the pulp for manufacture of bleached white paper.

Although the sodium compounds used in the aforedescribed process are relatively inexpensive, the quantities consumed in the 1500 tons of dry pulp per day production of an average pulp mill necessitate an economical recovery and re-cycle of the chemical values used for wood pulping. Moreover, such sodium-lignin complexes contain sufficient heat value and volatility to contribute favorably to the overall mill heat balance. These characteristics are combined in the liquor recovery furnace by fueling a boiler furnace with a concentrated flow stream of the spent or black pulping liquor. Combustion of the lignin fraction generates sufficient heat to evaporate the residual water vehicle and heat the steam required for the primary evaporative liquor concentration process. The residual ash, predominately sodium carbonate, falls to the furnace bed as a viscous smelt. Such smelt is cooled and dissolved in water to form the green liquor makeup stream from which the other fresh cooking liquor compounds are made.

Economics and thermal efficiency highly favor the use of such recovery furnaces but the practical, daily operation is critical and may be hazardous due to the explosive potential of a sodium-water reaction. Liquid sodium reacts to a combination of free water with explosive violence.

The presence of water containing boiler tubing above the furnace combustion chamber creates the greatest potential for such an explosion. As in any steam generating furnace, the boiler tubes are constantly subjected to high temperature and pressure stresses. In addition, however, such tubes in a sodium recovery furnace are subjected to a corrosive combustion atmosphere. Consequently, water leakage from the tubes is an ever present danger which occurs periodically as an operative fact and must be accommodated by appropriate safety procedures when it occurs.

Another necessary but hazardous operating circumstance arises from the viscous flow characteristics of the concentrated, 60% (plus) solids black liquor fuel that is consumed by such recovery furnaces. Such concentrated liquor fuel supply must be maintained above a certain temperature to be pumped and properly nebulized from spray nozzles for combustion. Consequently, the nozzle bearing spray guns are supplied from an externally heated circulation loop. Even so, in the course of normal operation, internal pipe walls of the circulation loop become coated with liquor deposits and, if allowed, will completely choke the passage. Accordingly, such circulation loop piping must periodically be purged with wash water. It is during such purging cycles that opportunity arises for an accidental discharge of purge water into the furnace smelt from an open liquor spray gun remaining in a firing port.

Still another hazardous operating circumstance relating to black liquor recovery combustion involves the critical balance of liquor solids and the heat available therefrom. Such liquor is derived from diverse pulp processing steps starting with the digester blow tanks and finishing with the pulp washers. The combination of aqueous residuals from such diverse steps is highly diluted and contains only about 5% solids. Accordingly, considerable concentration of the dilute liquor must occur before a combustible consistency is attained. Such concentration is a continuous evaporative process subject to numerous, critically balanced variables which occasionally fails to achieve the necessary 60 to 70% solids content. If the lignin/solids concentration in the black liquor fuel stream falls so low as to preclude sufficient lignin fuel content to evaporate all the water vehicle thereof, free water is available for direct, reactive contact with the sodium smelt in the furnace bed. When such conditions are allowed to continue, furnace explosions can and have occurred. For this reason, the solids content of the concentrated liquor to the spray guns is constantly monitored by means such as refractometer instruments. When the monitoring instruments detect a less than acceptable solids consistency, the pumps for the liquor spray supply loop are automatically stopped and automatic valves therein closed to preclude continued flows of such excessively dilute liquor to the spray guns.

Such response to a low liquor solids consistency condition meets the immediate explosion problem but creates a secondary problem of the supply loop line plugging as the liquor contained therein begins to cool. Consequently, under such conditions, the normal procedure is, as in the case of periodic line purge operation, to remove all liquor spray guns from their respective gun ports in the furnace wall and restart the circulation pumps so as to displace the low solids liquor in the liquor circulation piping system and to maintain sufficient fluidizing heat.

Whether prompted by periodic purge circulation or by a low liquor solids alarm, removal of liquor spray guns from respective furnace wall ports is a manual task. Unfortunately, such a recovery furnace has numerous liquor guns distributed about the firebox periphery. Consequently, the potential for oversight and failure to remove one or more guns is high. Moreover, the manual valves respective to each gun are subject to considerable handling abuse and tend to prematurely leak. A leaking gun tempts an operator to leave it in the port so he'll not have to cleanup the resulting floor mess.

It is, therefore, an object of the present invention to teach a method and apparatus which positively requires the removal of all liquor spray guns from a recovery furnace before the black liquor fuel supply circulation loop may be purged or resumed following a low consistency shutdown.

Another object of the present invention is to teach an apparatus for positively preventing the insertion if a liquor spray gun in a gun port during a periodic purge circulation interim or following a low consistency shutdown of the black liquor fuel supply system.

SUMMARY OF THE INVENTION

These and other objects of the invention which shall subsequently become apparent are accomplished by means of a swing safety gate apparatus for each firing port which, when closed, physically prevents the presence of a fuel gun in the port and also closes a switch in a series circuit including all such switches. When the black liquor fuel supply circulation system is stopped due to concurrent low consistency signals from the refractometers, all safety gate switches must be closed before the liquor circulation pump may be started again.

BRIEF DESCRIPTION OF THE DRAWING

Relative to the drawing wherein like reference characters designate like or similar elements throughout the several figures of the drawing.

DESCRIPTION OF THE PREFERRED EMBODIMENT

Figure 1:
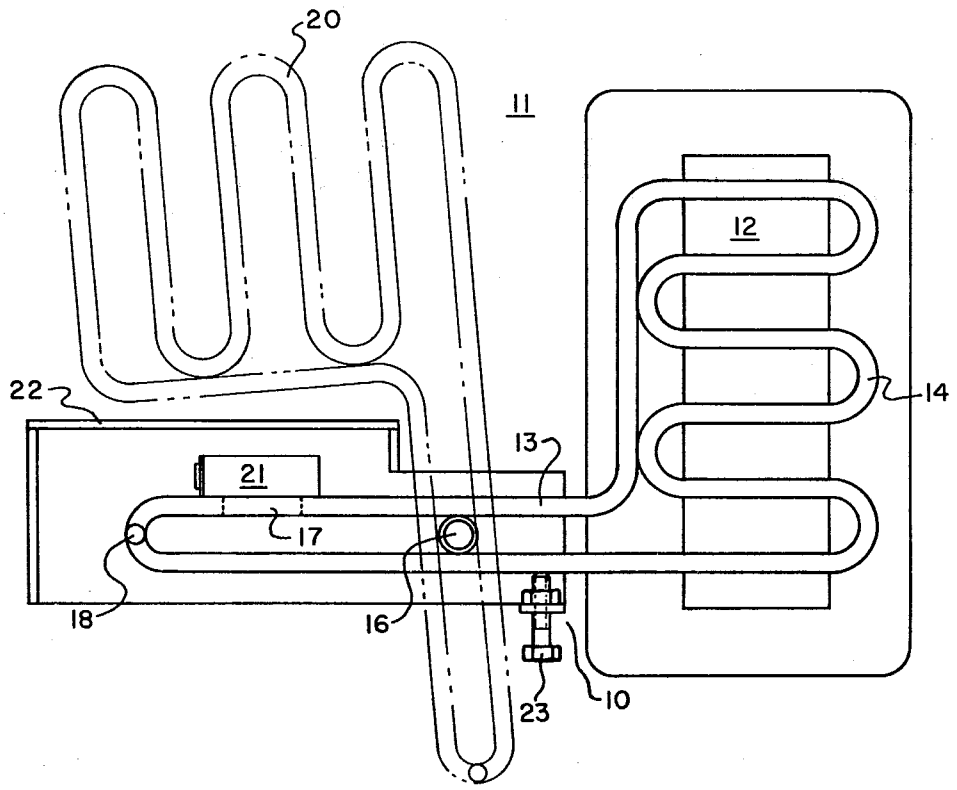
FIG. 1 is a detail illustration of the present invention safety gate.

An essential apparatus to the present invention system is illustrated by FIG. 1 and generally characterized as a swing gate 10. A swing gate 10 assembly is mounted to the recovery furnace wall 11 adjacent each firing port 12. There may be 15 or more firing ports in a recovery furnace, depending on the size of the furnace.

Each swing gate assembly comprises a bar grate 13 of ⅜ inch diameter stainless steel rod, for example, formed to the shape shown having a port 12 obstructing portion 14 and an arm portion 15. The dominate characteristic of the obstructing portion is that the spacing between the bar undulations be sufficiently close as to prohibit insertion of a liquor spray gun nozzle therebetween. Obviously, the undulating bar construction of the firing port obstructing portion 14 could be replaced by other structural configurations such as a solid plate or an expanded metal grate. However, to be acceptable, other configurations should accommodate the auxiliary functions of the firing ports 12 such as visual firebox inspection windows and supplementary air drafts. The illustrated bar construction is ideally suited to the task as accommodating both primary and auxiliary functions but it also efficiently dissipates the radiant and convective heat absorbed by the furnace flame exposed surfaces thereof.

The arm portion 15 of the grate assembly is provided with a pivot journal 16 about which the entire grate may be rotated to the open position illustrated by phantom line 20. If the suggested stainless steel construction is used, it will be necessary to provide a magnetic metal segment 17 on the arm 15 to operatively cooperate with the permanent magnet actuator of a single throw proximity switch 21. A more conventional mechanical push-button type of limit switch may be used in lieu of a magnetic switch if desired.

Accessory to the foregoing essential function components are an open bottomed protective enclosure 22 and an adjustable abutment 23. A handle protrusion 18 from the arm portion 15 distal end facilitates manual manipulation of the grate.

Figure 2:
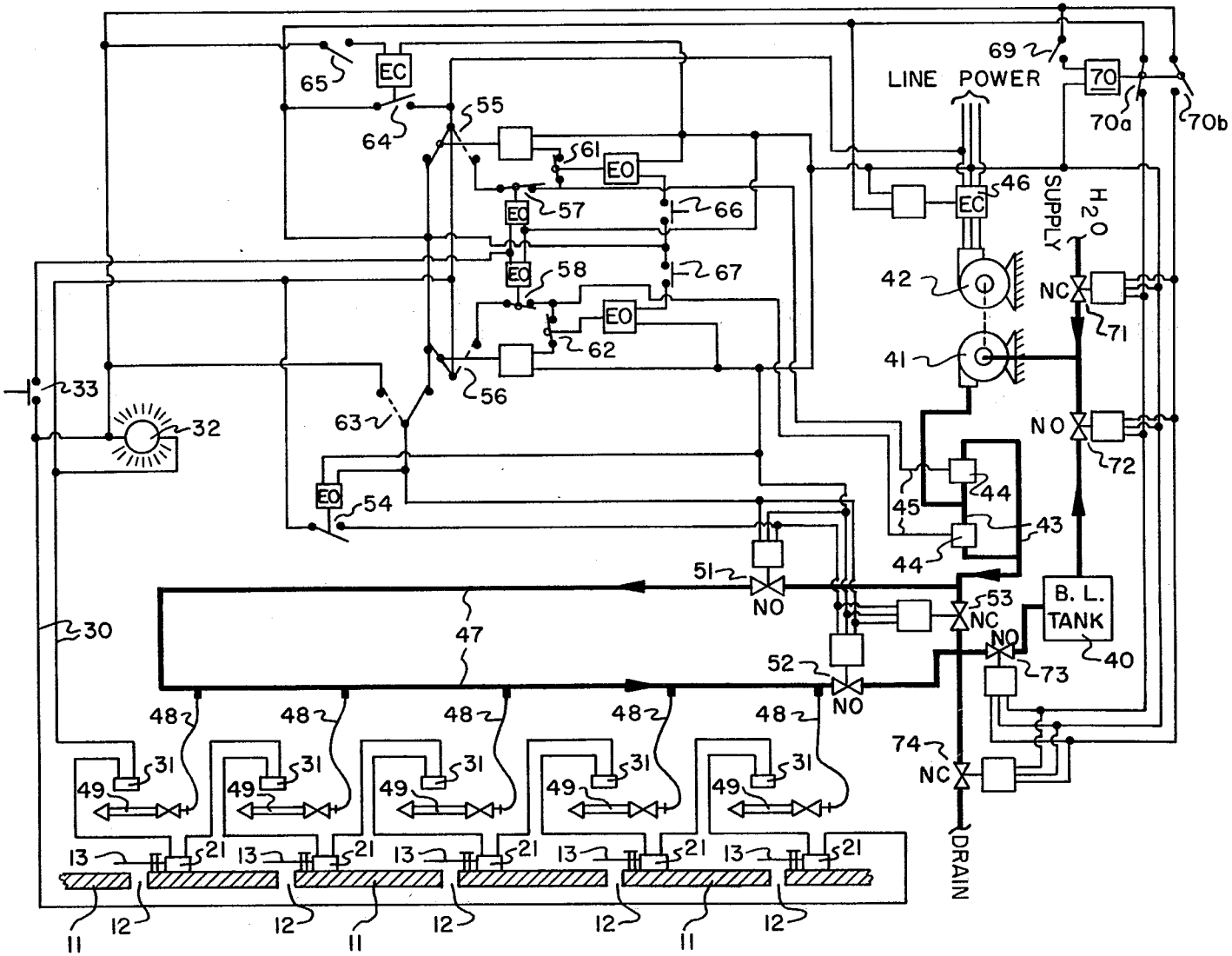
FIG. 2 is an integrated wiring and plumbing schematic of the present invention operating system.

The present invention safety system is schematically represented by FIG. 2 wherein the magnetic gate switches 21 are electrically connected in a series circuit 30 which also includes liquor gun holster switches 31, a safe alarm 32 and a start-up push-button switch 33.

The heavy line circuit portion of FIG. 2 represents the concentrated black liquor fuel circulation loop which comprises an externally heated circulation tank 40. From the tank 40, hot black liquor is drawn by a pump 41 driven by a prime mover such as electric motor 42. Pump 41 discharges into a parallel loop 43 wherein each shunt leg includes a refractometer 44 for continuously measuring the liquor consistency and emitting an actuating signal 45 in the event that such consistency falls below a predetermined set-point. The object of such parallel redundancy of liquor consistency monitoring is to require the concurrence of two identical instruments monitoring the same fluid flow stream as a condition precedent to further action. When such conditions occur, the entire flow stream is stopped by an interruption of line power to the pump motor 42 due to de-energization of the normally open, energize-to-close power relay 46.

Following refractance monitoring, the liquor fuel stream enters a ring header distribution pipe 47 around the periphery of the furnace 11. At appropriately spaced junctions, flexible conduits 48 carry the liquor from the header 47 to each of the manually manipulated liquor spray guns 49 which, in normal operation, are inserted through the firing ports 12 and held in the cradle of respective power oscillators.

Motor valves 51 and 52 in the header loop 47 provide automatic and immediate isolation of the header loop from the liquor supply when required. Motor valve 53 in a shunt leg between the pump 41 discharge and the circulation tank 40, is operatively interconnected with valves 51 and 52 so that the three valves function simultaneously with the starting and stopping of pump 41 motor 42. Header loop valves 51 and 52 close and shunt valve 53 opens when the pump 41 is stopped due to a commanded opening of power relay switch 46 in the motor 42 power supply.

Double throw solenoid switches 55 and 56, in the switch position illustrated by FIG. 2, direct operating power to the energized closed power relay 46 and the motor valves 51, 52 and 53 for normal running operation. Relay 54 in the motor valve control circuit is of the energized open type which closes upon loss of energy to the normal running circuit thereby connecting motive power to close motor valves 51 and 52 and open valve 53.

The illustrated normal running position for double throw switches 55 and 56 corresponds to the de-energized condition of the respective solenoids. Energization to throw these switches to the alternative, dotted-line, position is initiated by a signal pulse from the refractometers 44. Since switches 55 and 56 are in parallel with the line power, both switches must throw to de-energize the pump power relay 46. Upon switching to the alternative position, line power is connected to respective solenoid holding circuits which maintain the switches 55 and 56 in the alternative position. Also in the holding circuits are energized-to-open relays 57, 58 and 61, 62.

Relays 61 and 62 are in the switch 55 and 56 holding circuit to release one or the other in the event of a false actuating signal from one of the refractometers 44, for example. These relays 61 and 62 are of the normally closed, energize-to-open type which draw actuating energy from that portion of the normal operating circuit in parallel between the switches 55 and 56. Such actuating energy for the release relays 61 and 62 is normally interrupted by normally open, push-button switches 66 and 67. If only one of switches 55 or 56 is thrown to the alternative position by a false signal from a respective refractometer, normal operating power will remain available to the release relays 61 and 62 through the undisturbed switch 55 or 56. To restore the falsely thrown switch 55 or 56 to the normal operating condition, it is only necessary to manually close the appropriate push-button switch 66 or 67. On the other hand, if both switches 55 and 56 are thrown to the alternative position, no actuating energy is available to the release relays 61 and 62 notwithstanding closure of the push-button switches 66 or 67.

The solenoid operating circuit of holding circuit release relays 56 and 58 is in series with all the firing port gate switches 21 and the liquor gun holster switches 31. Consequently, operating power for these switches cannot be obtained unless all of switches 21 and 31 are closed. Even then, the double throw switches 55 and 56 will not throw to the running position due to normally open, manual switch 33. However, ready alarm 32 is provided to inform the operator that all firing ports 12 are safely closed and conditions are safe for liquor or wash water circulation through the header loop 47. Accordingly, when the ready alarm 32 indicates that all firing ports 12 are positively closed and all guns 49 are securely holstered, manual switch 33 may be closed to release holding relays 57 and 58 and allow re-start of pump 41.

It will be noted that gun holster switches 31 are redundant to gate switches 21 since the latter positively serves the primary safety objective. Singularly, the gun holster switches 31 cannot positively assure undesired fluid discharges through the firing ports 12 since it is common practice to have more guns 49 in the furnace proximity than firing ports 12 as maintenance replacements. Consequently, it would be possible to satisfy all gun holster switches 31 with one or more unconnected replacement guns 49 and still have an actively working gun in the port 12. Nevertheless holster switches 31 have a desirable housekeeping function by providing a reasonably reliable signal that the active guns 49 are holstered in appropriately drained sockets.

Auxiliary to the primary safety circuit heretofore described, are dependent circuits which permit safe operating flexibility pursuant to system maintenance.

Energized-to-close relay 64 is disposed between the primary line power and the pump power relay 46. Actuation energy is provided by the series gate switch 21 circuit. Consequently, if all switches 21 and 31 are closed, power is thereby available to start the pump 41 with a selective closure of manual switch 65. However, should any of the switches 21 and 31 be subsequently opened, energized-to-close relay 64 will also open thereby stopping the pump 41.

Adjunctive to the above safe running circuit for the pump 41 is an auxiliary switching circuit for permitting liquor to be circulated through the circulating loop 47 so long as all gates 13 are closed and guns 49 are holstered. Manual switch 63 is normally closed to the running position illustrated which drives the circulating loop valves 51 and 52 to the open position and shunt valve 53 to the closed position. When switch 63 is changed to the alternative position, power is derived from the gate switch 12 circuit which is inoperative unless all of switches 21 and 31 are closed. If power is available from the gate switch circuit, closure of switch 63 therewith will open the energize-to-open relay 54 thereby driving valves 51 and 52 open and valve 53 closed. Should power to the gate circuit fail as by reason of opening a switch 21 or 31, so, too, will power to the energize-to-open relay 54 fail thereby permitting relay 54 to close and complete the valve 51 and 52 closure circuit.

For the purpose of periodic liquor line flushing with fresh water or dilute black liquor, autovalves 71, 72, 73 and 74 are provided. Valve 71 in the flush water or liquor supply line is normally closed. Valve 72 in the fuel liquor tank 40 supply line is normally open as is valve 73 in the circulation loop 47 tank return line. Valve 74 to the liquor drain lines is normally closed. All of these valves are interlocked to be simultaneously operated to jointly compatible positions by the relay 70 which has mechanically interlocked opposite switch positions for two contact sets **70*a* and 70*b*. Actuation energy for the relay 70 is obtained from the firing gate circuit subject to a manual switch 69. In the normal running condition, no operating energy is available to the relay 70 which is statically biased to the switch 70*a* closure condition corresponding to a valve 72 and 73 open position and valves 71 and 74 to the closed position. To reverse the switch 70 contact condition whereby contacts 70*a* open and contacts 70*b* close, manual switch 69 must be closed upon a charged firing gate circuit. Should the firing gate circuit be subsequently opened, actuating energy to the relay 70 will fail thereby permitting reversion of the contacts 70*a* and 70*b*** to the illustrated normal running position.

Having fully disclosed my invention, those of ordinary skill in the art will recognize obvious alternatives and mechanical equivalents to accomplish the same or similar objectives. For example, I have chosen electrically operated motor valves for my preferred embodiment. Obviously, pneumatic or hydraulic control valves may be substituted for the motor valves if desired. Similarly, relays and solenoid switches are utilized in the control circuit. Many of such devices may be replaced by solid-state conductive devices. Therefore, as my invention,

I claim:

1. A liquor supply system for a paper pulp mill liquor recovery furnace comprising:

A. Circulation loop means for distributing spent pulp mill liquor about a combustion zone portion of said furnace;

B. Pump means for driving said liquor through said loop means;

C. Condition responsive power means having normal and emergency operating modes for driving said pump means;

D. Condition responsive flow diversion means for selectively obstructing liquor flow through said loop means;

E. A plurality of manually positionable liquor spray guns connected to said loop means for selective positionment into apertures within furnace walls about said combustion zone;

F. Selectively positionable, non-draft obstructing barrier means respective to each of said apertures for prohibiting the presence of a spray gun within a respective aperture when said barrier means is positioned there across; and G. Position responsive and mutually dependent signal means respective to each of said barrier means for permitting said power means to drive said pump means in the emergency operating mode on the condition that all of said barrier means are mutually aligned across respective apertures.

2. An apparatus as described by claim 1 wherein flow diversion means permits liquor flow through said loop means when said pump means is in the emergency operating mode on the condition that all of said barrier means are mutually aligned across respective apertures.

3. An apparatus as described by claim 1 wherein each of said barrier means comprises an undulated rod means secured to a support arm, said support arm being pivotably mounted to said furnace wall adjacent a respective aperture whereby said rod means may be selectively pivoted between an aperture obstructing position and a non-obstructing position.

4. An apparatus as described by claim 1 wherein said power means comprises safe operating condition sensing means to direct said power means from said normal operating mode into said emergency mode, said normal operating mode having circuit means for energizing said pump means regardless of the positionment of any one or all of said barrier means, said emergency operating mode having circuit means for energizing said pump only if all said barrier means are obstructing respective apertures.

5. An apparatus as described by claim 4 wherein said flow diversion means is connected to said normal operating circuit means for permitting liquor flow through said loop means when said power means is in the normal operating mode and connected to said emergency operating circuit means when said power means is in the emergency operating mode wherein said emergency operating circuit connection of said flow diversion means terminates operating energy to said flow diversion means to interrupt liquor flow through said loop means unless all of said barrier means obstruct respective apertures.

6. A pulp mill recovery furnace safety appliance comprising:

Barrier means having a mounting bar portion projecting from a liquor spray gun aperture blocking portion;

Pivot means in said bar portion secured to recovery furnace structure adjacent said aperture for pivoting said barrier means to and from an aperture blocking position; and Electrical switch means secured proximate of said barrier means for actuation between closed and open contact conditions by positionment of said barrier means at spray gun aperture blocking and open positions, respectively.

7. Apparatus as described by claim 6 wherein an assembly of said barrier means, pivot means and switch means is provided for all spray gun apertures in said furnace, said switch means being serially connected in override circuit means for energizing a liquor circulation pump if all switch means are closed by positionment of said barrier means to block respective apertures.

8. Apparatus as described by claim 6 wherein said spray gun aperture blocking portion of said barrier means comprises an open spaced structure to permit sight and furnace draft through said aperture.

9. Apparatus as described by claim 8 wherein said open spaced structure comprises an undulating pattern of metallic rod.

10. A method of operating a pulp mill recovery furnace having black liquor pumped through a circulation loop for distribution to manually positioned liquor spray guns connected to said loop, said spray guns being selectively positioned within apertures through combustion zone walls of said furnace, said method comprising the steps of:

A. sensing at least one parameter indicative of furnace operational safety;

B. terminating liquor flow to said circulation loop when said parameter indicates an unsafe condition;

C. removing all liquor guns from said apertures; and,

D. positioning barrier means across all said spray gun apertures in said combustion zone walls so as to preclude the presence of a spray gun therein and to actuate a permissive energizing circuit for restoring liquor flow to said circulation loop.

11. A method as described by claim 10 wherein positionment of said barrier means across said apertures permits substantially unobstructed sight and combustion support draft through said apertures.

12. A method as described by claim 10 wherein positionment of said barrier means across said apertures closes respective switch means, all of said switch means being serially connected to complete said permissive energizing circuit.

* * * * *